United States Patent [19]

Ayache et al.

[11] 4,329,113

[45] May 11, 1982

[54] TEMPERATURE CONTROL DEVICE FOR GAS TURBINES

[75] Inventors: Michel R. Ayache, Epinay sous Senart; Pierre A. Glowacki, Melun; Gerard M. F. Mandet, Epinay sous Senart, all of France

[73] Assignee: Societe Nationale d'Etude et de Construction de Moteurs d'Aviation, Paris, France

[21] Appl. No.: 82,338

[22] Filed: Oct. 5, 1979

[30] Foreign Application Priority Data

Oct. 6, 1978 [FR] France ..... 78 29080

[51] Int. Cl.[3] ..... F01D 11/08

[52] U.S. Cl. ..... 415/116; 416/174

[58] Field of Search ..... 415/116–117, 415/174, 175

[56] References Cited

U.S. PATENT DOCUMENTS 3,825,364 7/1974 Halila et al. ..... 415/174 X 3,966,354 6/1976 Patterson ..... 415/116

4,222,706 9/1980 Ayache et al. ..... 415/174 X 4,222,707 9/1980 Drouet et al. ..... 415/116

FOREIGN PATENT DOCUMENTS 1484288 9/1977 United Kingdom ..... 415/116

*Primary Examiner*—Everette A. Powell, Jr.

*Attorney, Agent, or Firm*—Oblon, Fisher, Spivak, McClelland & Maier

[57] ABSTRACT

A portion of the stator of a gas turbine known as turbine shroud, which is situated radially opposite the mobile vanes of a turbine stage includes an "abradable" member supported by a first shell braced by a second shell and connected with turbine casing 2 by a thin, i.e. flexible, annular wall member embedded in a casing. Cooling air inflates the second shell so as to brace the exterior shell and circulates between the two shells so as to cool them and also cools the "abradable" member by impingement. The present invention is applicable to aviation turbojets.

7 Claims, 2 Drawing Figures

TEMPERATURE CONTROL DEVICE FOR GAS TURBINES

BACKGROUND OF THE INVENTION

1. Field of the Invention

The present invention relates to gas turbines and concerns, more precisely, the portion of a turbine stator known as the turbine shroud, which is located so as to face the mobile vanes of a turbine stage. This invention is applicable particularly to aviation turbojets.

2. Description of the Prior Art

It is important to achieve as small a radial tolerance as possible between the turbine shroud and the tips of the mobile vanes, any excessive play being prejudicial to the efficiency of the turbine. One known technique used to insure very small tolerances is to form the inside surface of the turbine shroud as one piece, called an "abradable" member capable of wearing down under the friction caused by the vanes without any risk of deteriorating the latter. However, if such wear occurs at a certain turbine load, it will increase the play under a different load. Thus, it is necessary to avoid wear as much as possible and, to that effect, prevent relative deformation of the turbine shroud in relation to the turbine shroud, whatever the load conditions in the turbine.

SUMMARY OF THE INVENTION

The object of the present invention is to permit the production of a shroud supporting the "abradable" member whose thermal expansions will be as identical as possible with those of the mobile blading, and which will maintain its circular shape as it expands and contracts under thermal variations.

The turbine shroud in accordance with this invention comprises, in combination, a braced and cooled annular shell supporting the "abradable" member connected to the turbine casing by means of a thin annular wall whose one extremity is rigidly anchored to said shell and whose other extremity is attached to said casing.

Owing to its structure as a braced shell, the shroud supporting the "abradable" member presents considerable mechanical inertia, so that it does not run the risk of deformation, such as ovaling. Thanks to cooling, this shroud can conform to the thermal expansions and contractions of the turbine rotor, the differential expansions and contractions of this shroud in relation to the turbine casing being absorbed by the bending of the thin annular wall.

In one embodiment, bracing is formed by a second shell disposed inside the first one, means being provided to feed compressed air into the second shell, thus giving support to said first shell, and to circulate cooling air between the two shells, thereupon leading this air to the "abradable" member so as to cool the latter by impingement.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Figure 1:
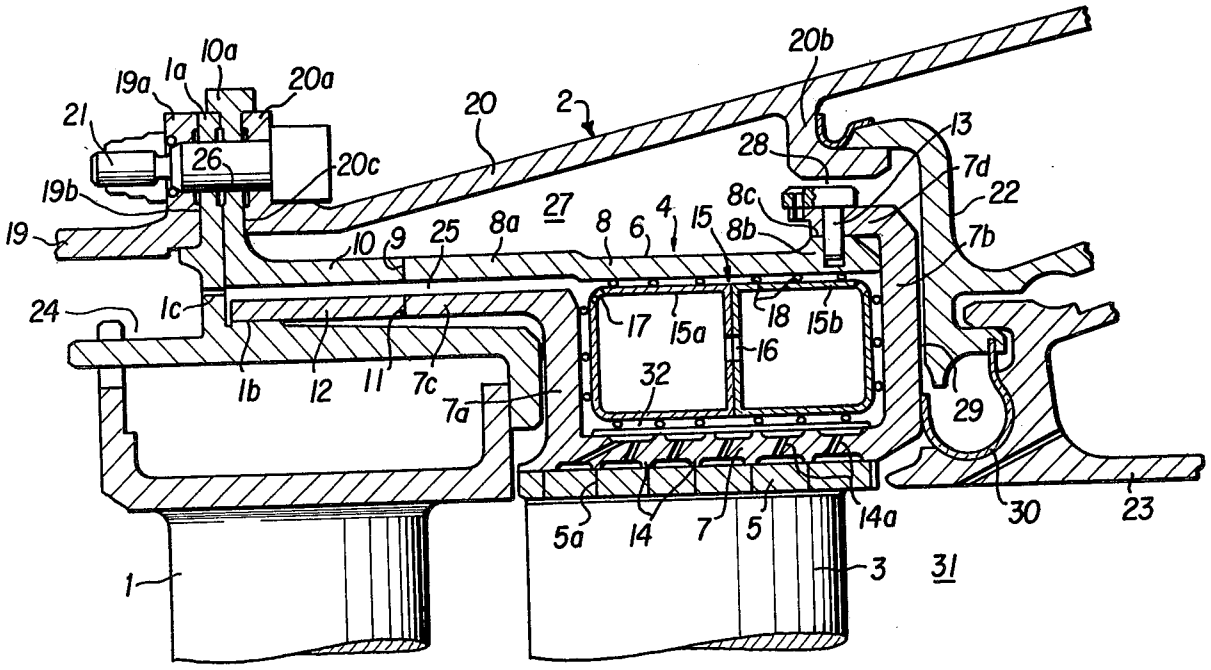
FIG. 1 is an axial, partial, half-sectional view of one stage of an aviation turbojet, presenting a turbine shroud in accordance with the invention.

In FIG. 1 can be seen one stage of gas turbine that is part of an aviation turbojet which is not shown in its entirety and which comprises, in the familiar manner, a compressor forcing compressed air into an annular casing containing a combustion chamber in which fuel is burned to produce hot gases which perform work in the turbine before being expelled through a nozzle to produce a propulsive jet. The turbine stage shown comprises a distributor blading 1 connected to turbine casing 2 by a flange 1*a*, and a mobile blading 3 rotating in a turbine shroud 4.

Turbine shroud 4 comprises an annular part 5, called an "abradable" member made of a material that is capable of being worn down by friction as the vanes of mobile blading 3 bear down upon it, without any risk of deteriorating said vanes, this "abradable" member being anchored to inside wall 7 of annular shell 6 whose outside wall 8 extends toward the upstream end of the turbine by means of a wall portion 8*a* which is welded at 9 to another wall 10 that is integral with flange 10*a*. Wall 8, 8*a* is of an essentially cylindrical shape and carries at its downstream extremity an annular portion 8*b* that is thickened toward the outside and whose external surface 8*c* forms a cylindrical bearing surface.

Internal wall 7 is integral with upstream wall 7*a* and downstream wall 7*b* which run radially toward the exterior and which are thicker than wall 7 itself.

Downstream wall 7*a* is in turn integral with cylindrical wall 7*c* running upstream and welded at 11 to another wall 12 whose upstream extremity rests on cylindrical bearing surface 1*b* of the annular support of distributor 1. Downstream wall 7*b* is integral with cylindrical appendage 7*d* which fits onto cylindrical bearing surface 8*c* of the thick portion of wall 8*b* and which is immobilized axially in relation to the latter by a plurality of smooth pins 13 which are force-fitted in a crown-like configuration.

The inside face of interior wall 7 comprises several circular ribs 14 to which is attached "abradable" member 5. This "abradable" member 5 is made of porous material similar to the one described in French Patent application Ser. No. 77 26638 of Aug. 26, 1977 and, like the latter, features walls 5*a* produced by electron bombardment in order to prevent the cooling fluid, which is described hereinbelow, from circulating axially in the "abradable" member. Since the "abradable" member is not part of this invention, it is not deemed necessary to describe it in greater detail. Further details regarding the "abradable" member and its mounting on the "abradable carrier" can be obtained from the above-mentioned French Patent application. Between ribs 14, wall 7 is traversed by oblique passages 14*a*.

Inside annular shell 6 is mounted a second annular shell 15 made of sheet metal. This shell 15 is composed of two elements 15*a* and 15*b*, joined side-by-side by their radial walls which are perforated by a plurality of apertures 16 in crown-like disposition. The upstream wall of upstream element 15*a* is also perforated at its junction with the external cylindrical wall of this element 15*a* by a plurality of apertures 17 in a crown-like configuration. Shell 15 thus forms a hollow shroud, and onto its four faces (i.e. the two cylindrical faces—interior and exterior, the upstream face and the downstream face) are welded ball bearings 18 which, at rest, bear on the interior surfaces opposite shell 6.

The portion shown of turbine casing 2 comprises an upstream sleeve 19 provided at its downstream extremity with a flange 19*a*, and a downstream sleeve 20 provided at its upstream extremity with an outside flange 20*a*. Flanges 1*a* and 10*a* are pressed between these flanges 19*a* and 20*a* by the bolts 21. Downstream sleeve 20 is internally equipped opposite downstream wall 7*b* of sleeve 6, with an annular flange 20*b* that has an L-shaped cross-section, to which is attached annular support 22 of the distributor of the following stage of the turbine, which is partially represented in 23.

Between upstream sleeve 19 of the turbine casing and distributor 1, there is an annular conduit 24 connected with the casing of the combustion chamber (not shown) which is fed compressed air at 25 bars. This annular conduit 24 is connected, by apertures 1*c* in flange 1*a*, with an annular conduit 25 provided between cylindrical walls 8*a*, 10 and 7*c*, 12 and which opens up into annular shell 6. Apertures 26 in flanges 1*a* and 10*a* through which pass bolts 21 have a slightly larger diameter than these bolts and thus form passages around them which connect with conduit 24 and annular space 27 formed between sleeve 2 and walls 8, 8*a* and, 10 by means of canals 19*b* and 20*c* machined radially into the downstream face of flange 19*a* and into the upstream face of flange 20*a*, respectively.

Space 27 connects, by means of an annular passage 28 between L-shaped flange 20*b* and cylindrical appendage 7*d*, with space 29 formed between wall 7*b* and support 22, and space 29 is separated, by an annular omega-shaped seal 30 perforated by small apertures, from the internal flow of hot gases or "jet" 31 of the turbine. The static pressure of the jet at the exit from blading 3 being on the order of 5 bars, the apertures perforated in seal 30 are calibrated so as to create the drop in pressure required to avoid any perturbation of the jet at the downstream end of the turbine and, simultaneously, to maintain in space 27 a level of pressure sufficient to keep the shroud from becoming core-shaped under the pressure of the jet.

During operation, cooling air taken from the combustion chamber casing (not shown) flows through annular conduit 24 and, at the downstream extremity of the latter, separates into two streams; a first stream which flows through canals 19*b*, passages 26 surrounding bolts 21 and canals 20*c* into space 27, from where it flows into jet 31 through annular passage 28, space 29 and the apertures of seal 30 and a second stream, with a clearly higher rate of flow than the first one, which flows through apertures 1*c* into annular conduit 25 and, at the downstream extremity of the latter, separates into several currents some of which flow between wall 8 and exterior wall of shell 15, then between the wall of shell 15B and the downstream wall of this shell 15, ending up in space 32 formed between wall 7 and the interior wall 7 of shell 6, the other currents end up in this same space 32 by flowing between wall 7*a* and the upstream wall of shell 15. The cooling air thus entering space 32 escapes from the latter through oblique passages 14*a* so as to cool by impingement the "abradable" member 5 and flows through the pores of the latter into jet 31. The air flowing through the downstream extremity of annular passage 24 also enters shell 15 through apertures 17, keeping said shell under pressure and "inflating" it in such a manner that ball bearings 18 are tightly pressed against the walls of shell 15, which has the effect of maintaining at a high level the mechanical inertia of the latter and, consequently, of preventing any deformation, such as ovaling, under the action of the thermal stresses applied to it.

The cooling air taken from the combustion chamber casing is at a fairly elevated temperature, so that shell 6 and the elements that are integral with it (i.e. portions of walls 8*a* and 7*c*) must be made of a material characterized by a low coefficient of expansion in order to avoid differential thermal expansions between shell 6 and rotor blading 3. In the described embodiment, shell 6 and walls 8*a* and 7*c* are made of NCK 20 D alloy. Elements 10 and 12, on the other hand, are made of the same material as turbine casing 2.

It will be noted that, thanks to the flexibility of wall 8*a*, 10 which connects it to casing 2, the "abradable carrier" of high mechanical inertia formed by the combination of shells 6 and 15 can expand and contract freely to conform to the thermal expansions and contractions of rotor blading 3. These expansions and contractions cause only wall 8*a*, 10—and, secondarily, wall 7*a*, 12—to bend. In order to minimize the bending stress applied to welds 9 and 11, the latter are placed midway between wall 7*a* of shell 6 and framing flange 10*a*, i.e. at a point where the bending stresses are almost zero.

The shell shape of "abradable carrier" shroud 6 offers the advantage of giving it significant inertia so as to avoid any buckling under the pressure of the cooling air. To this effect, as can be seen in the drawing, radial walls 7*a* and 7*b* are made comparatively thick. Inside, shell 15 contributes to the efficient cooling of these thick walls and insures even cooling of the latter. An additional advantage of this shell 15 is that it serves as a dust trap since the particles carried by the air stream which flows through conduit 25 have an inertia that is too high for them to traverse the corner between outside shell 6 and inside shell 15 and they thus penetrate through apertures 17 onto the latter, where they are slowed down and trapped.

Figure 2:
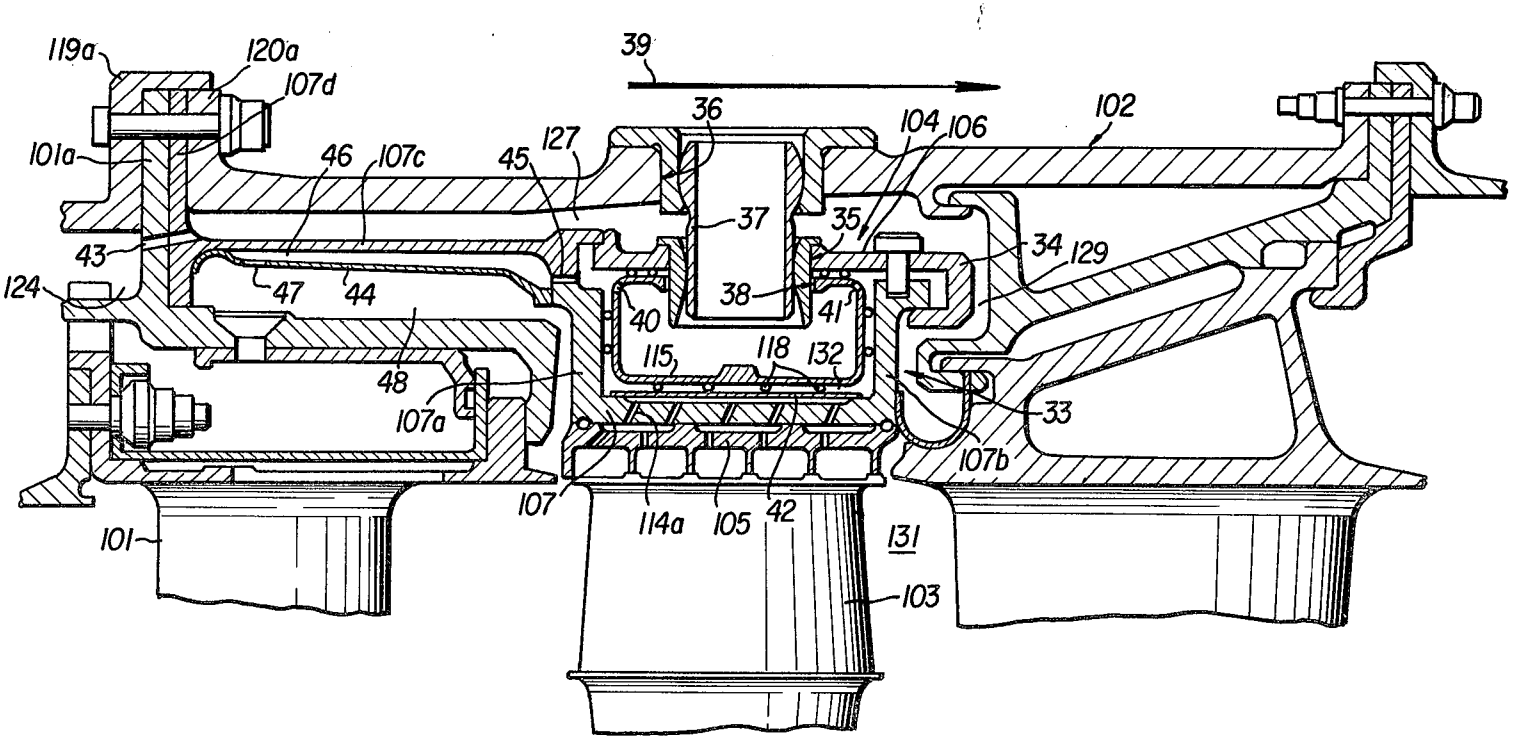
FIG. 2 is a view similar to that of FIG. 1, showing a second embodiment of the present invention.

FIG. 2, in which elements serving the same function as in FIG. 1 are designated by the same reference numbers augmented by a 100 series, shows an embodiment in which outside shell 106 is composed on two annular parts, to wit a first part 33, which forms walls 107, 107*a* and 107*b* and whose 107*c* portion extends to a flange 107*d* which is attached to flanges 119*a* and 120*a* of the casing, and a part 34 which completes the shell between walls 107*a* and 107*b*. This annular part 34 is perforated by apertures 35 of a crown-like configuration, each facing an aperture of casing 102. Each aperture 35 is connected to aperture 36 facing it by a length of tube 37 mounted with swivel joints at both ends. Internal sheet metal shell 115 is perforated opposite each aperture 35 by an aperture 38 which is thus connected through tube 37 with the secondary air flow (indicated, schematically, by arrow 39) around casing 102. Internal shell 115 is thus "inflated" by secondary air flow 39.

This secondary air flow escapes from inside shell 115 through two series of apertures 40, 41, circulates between the two shells and enters space 132, which is here limited internally by a cylindrical sheet metal wall 43. After flowing through this perforated wall, the air flows through oblique passages 114*a* of wall 107 so as to cool "abradable" member 105 by impingement and crosses the latter to end up in jet 131.

The relatively warm air taken from the combustion chamber casing by means of annular conduit 124, flows at reference numeral 43 through flanges 101*a* and 107*d*, enters spaces 127, then 129 and joins up with jet 131. Flange 107*d* being thus ventilated by relatively warm air, it is necessary—in order to insure the mechanical strength of wall 107*c*—to provide for as linear as possible a temperature gradient between this wall 107*c* and shroud 104. To this effect, a reflux heat exchanger is created by means of a compound sleeve of sheet metal between wall 107*c* and distributor 101. Part of the fresh air circulating between the two shells flows through apertures 45 of wall 107*a* into annular space 46 formed between wall 107*c* and sleeve 44, through apertures 47 close to the upstream extremity of this sleeve 44 to enter annular space 48 formed between the latter and distributor 101, and escapes into jet 131 through the space formed between this distributor 101 and wall 107*a*. Thus, the internal face of flexible wall 107*c* is bathed by secondary air that is relatively cool, while its external face is exposed to the relatively warm air of the combustion chamber casing.

One advantage of the embodiment shown in FIG. 2 is that the cooling air taken through tubes 37 may have its temperature and rate of flow controlled by a secondary control device. Therefore, annular shell 106 may constitute a material of the same nature as that of casing 102. Another advantage is to permit, through appropriate metering of the warm air taken in the combustion chamber casing and cold air taken from the secondary air flow, control of the radial tolerance between "abradable" member 105 and mobile blading 103.

Having generally described this invention, a further understanding can be obtained by reference to certain specific embodiments which are provided herein for purposes of illustration only and are not intended to be limiting unless otherwise specified.

What is claimed as new and desired to be secured by Letters Patent of the United States is:

1. A gas turbine shroud including a casing and an abradable member mounted on an annular support, said support comprising:

a first annular shell having an interior wall portion;

a flexible annular wall interconnecting said first shell to said turbine casing;

a second shell mounted inside said first shell for bracing said first shell and for receiving compressed air so as to brace said first shell; and means for circulating air between said first and second shells so as to cool said first and second shells and for circulating air along said interior wall portion of said first shell onto said abradable member so as to cool said abradable member by impingement with air.

2. A turbine shroud as set forth in claim 1 operatively connected to a combustion chamber; wherein said means for circulating air further comprises a combustion chamber casing and wherein said second shell further comprises a perforated section to which the air is circulated such that two air currents are formed at the level of said perforated section so as to circulate between said first and second shell and to trap dust.

3. A turbine shroud as set forth in claim 2, said flexible wall further comprising first and second parts secured end-to-end, said first part being integral with said first shell wherein said second shell further comprises a material having a low coefficient of thermal expansion, said second part being connected to said turbine casing and comprising the same material as said casing.

4. A turbine shroud as set forth in claim 3 further comprising means for connecting said second part of said flexible wall to said turbine casing and wherein said first and second parts of said flexible wall are secured together at a point approximately midway between said means for connecting said second part of said flexible wall to said turbine casing and said first shell such that bending stresses at said midway point are nearly zero.

5. A turbine shroud as set forth in claim 4, said second shell comprising first and second parts integrally secured, said first and second parts of said first and second shells respectively forming a passage for circulation of air to said abrading member and further comprising a turbine distributor wherein said second part of said second shell contacts said turbine distributor and comprises the same material as said casing.

6. A turbine shroud as set forth in claim 2, wherein said air further comprises air circulating from said combustion chamber and communicating with an exterior wall of said flexible wall, with an exterior face of an outside wall of said first shell and with a downstream face of a downstream wall of said first shell such that said air is expelled into a turbine jet, said second shell including passages radially crossing said outside wall and communicating with cool secondary air flowing around said casing, and said secondary air inflating said second shell and escaping through apertures formed in said second shell so as to form a stream of air which circulates between said first and second shells.

7. A turbine shroud as set forth in claim 6, further comprising a sheet metal sleeve member disposed between said first and second shells having a plurality of apertures formed therein.

* * * * *